US011043352B1

(12) United States Patent
Snow

(10) Patent No.: US 11,043,352 B1
(45) Date of Patent: Jun. 22, 2021

(54) ALIGNED GRAIN STRUCTURE TARGETS, SYSTEMS, AND METHODS OF FORMING

(71) Applicant: Varex Imaging Corporation, Salt Lake City, UT (US)

(72) Inventor: Michael Snow, Farmington, UT (US)

(73) Assignee: Varex Imaging Corporation, Salt Lake City, UT (US)

( * ) Notice: Subject to any disclaimer, the term of this patent is extended or adjusted under 35 U.S.C. 154(b) by 0 days.

(21) Appl. No.: 16/723,576

(22) Filed: Dec. 20, 2019

(51) Int. Cl.
*H01J 35/10* (2006.01)
*H01J 35/08* (2006.01)

(52) U.S. Cl.
CPC ..... *H01J 35/10* (2013.01); *H01J 35/112* (2019.05); *H01J 2235/081* (2013.01); *H01J 2235/083* (2013.01)

(58) Field of Classification Search
CPC ..... H01J 35/08; H01J 35/10; H01J 2235/081; H01J 2235/08; H01J 2235/104
See application file for complete search history.

(56) References Cited

U.S. PATENT DOCUMENTS 2,521,663 A * 9/1950 Zunick ..... H01J 35/10 378/121
2,921,875 A 1/1960 Schnitzel
3,328,626 A 6/1967 Natter
3,547,712 A 12/1970 Bourne
3,737,699 A * 6/1973 Gager ..... H01J 35/10 378/129
3,975,219 A 8/1976 Allen
4,002,503 A 1/1977 Bourne
4,063,939 A 12/1977 Weaver
4,298,816 A 1/1981 Hirsch
4,673,124 A 6/1987 Conolly
4,879,091 A 11/1989 Samal
5,030,275 A 7/1991 Samal
5,273,956 A 12/1993 Johnson
5,422,539 A 6/1995 Chodora
5,699,401 A 12/1997 Jackson
6,109,995 A 8/2000 Altmann
6,274,802 B1 8/2001 Fukuda
6,289,080 B1 9/2001 Hasz
6,372,346 B1 4/2002 Toth
6,419,758 B1 7/2002 Bewlay
6,454,991 B1 9/2002 Yoshimura
6,487,275 B1 * 11/2002 Baba ..... H01J 35/10 378/143
6,595,821 B2 7/2003 Itoh
(Continued)

FOREIGN PATENT DOCUMENTS

CN 102444428 A 5/2012
EP 0209632 B1 7/1990
(Continued)

*Primary Examiner* — David P Porta
*Assistant Examiner* — Fani Boosalis
(74) *Attorney, Agent, or Firm* — Laurence & Phillips IP Law

(57) ABSTRACT

Some embodiments include an x-ray system, comprising: a support structure including a mounting surface; a target attached to the support structure on the mounting surface; wherein the target has a grain structure having a first dimension along an axis perpendicular to the mounting surface is longer than a longest dimension along any axis parallel to the mounting surface.

20 Claims, 7 Drawing Sheets

(56) References Cited

U.S. PATENT DOCUMENTS

| | | | |
|---|---|---|---|
| 6,830,637 | B2 | 12/2004 | Morgan |
| 7,601,399 | B2 | 10/2009 | Bamola |
| 7,860,220 | B2 | 12/2010 | Aoyama |
| 8,088,232 | B2 | 1/2012 | Lemon |
| 8,425,833 | B2 | 4/2013 | Lemon et al. |
| 8,671,609 | B2 | 3/2014 | Fonte |
| 9,309,591 | B2 | 4/2016 | Lemon |
| 9,368,318 | B2 | 6/2016 | Eiter |
| 9,783,882 | B2 | 10/2017 | Miller |
| 10,144,087 | B2 | 12/2018 | Iqbal |
| 10,163,600 | B2 | 12/2018 | Yamamoto |
| 2001/0033637 | A1 | 10/2001 | Hasz et al. |
| 2003/0183306 | A1 | 10/2003 | Hehmann et al. |
| 2004/0206429 | A1 | 10/2004 | Morgan et al. |
| 2008/0181366 | A1 | 7/2008 | Bamola et al. |
| 2009/0214373 | A1 | 8/2009 | Stinson et al. |
| 2011/0089030 | A1 | 4/2011 | Juliano et al. |
| 2014/0126702 | A1* | 5/2014 | Haag ..... H01J 35/06 378/140 |
| 2015/0023473 | A1* | 1/2015 | Rodhammer ..... H01J 35/10 378/144 |
| 2016/0020061 | A1* | 1/2016 | Ikarashi ..... H01J 35/08 378/64 |
| 2016/0133430 | A1* | 5/2016 | Yamada ..... H01J 35/08 378/143 |

FOREIGN PATENT DOCUMENTS

| | | | |
|---|---|---|---|
| EP | 09394271 | B1 | 1/2003 |
| EP | 1683883 | A1 | 1/2006 |
| EP | 20654801 | B1 | 5/2012 |
| EP | 1953254 | B1 | 12/2012 |
| JP | 3774625 | B2 | 5/2006 |
| JP | 5318090 | B2 | 10/2013 |
| JP | 2014506711 | A | 1/2015 |
| KR | 20180021533 | A | 3/2018 |

* cited by examiner

ALIGNED GRAIN STRUCTURE TARGETS, SYSTEMS, AND METHODS OF FORMING

X-ray tubes may include a target material that generates x-rays in response to incident electrons. The target material may be subjected to cyclical thermal stress during operation. The target material may crack and/or separate from a mounting surface within the x-ray tube due to the thermal stress, leading to failure of the x-ray tube.

DETAILED DESCRIPTION

Some embodiments relate to an aligned grain structure target, systems including such a target, and methods of forming the same. In some embodiments, a tungsten, tungsten-rhenium, or any other material suitable for generating x-rays may be used or a target for a stationary anode. Some of these materials may improve the strength of the target material especially under cyclical thermal stresses. However, cyclical thermal stresses may still cause the target to crack, delaminate, or otherwise fail. Embodiments described herein include a target material having a grain structure that may reduce the likelihood of delamination, cracking, or the like that may cause the system to fail.

Figure 1A:
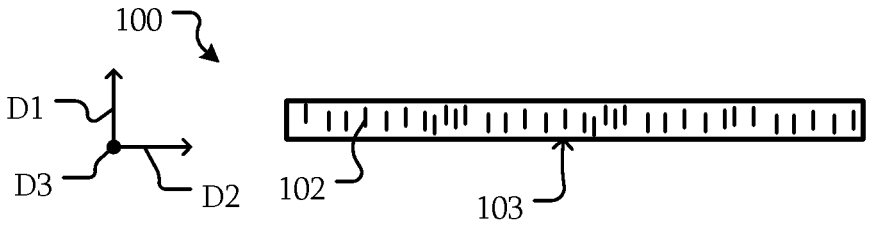
FIG. 1A is a block diagram of a target having a grain structure according to some embodiments.

FIG. 1A is a block diagram of a target having a grain structure according to some embodiments. The target 100 may be formed of a variety of materials. For example, the target may include tungsten, rhenium, rhodium, palladium, combinations of alloys of such materials, or the like. The target 100 may have properties designed for generating X-rays from electron emissions and/or maintaining structural integrity due to high temperatures generated from heat from the electron bombardment. As will be described in further detail below, the target 100 may be more easily manufactured than other targets with different grain structures.

In some embodiments, the target 100 has a grain structure 102 that is elongated along axis D1. Here, the elongated grain structure 102 is illustrated with line showing a general direction of the major axis of the grains. Each grain of a target material may be oriented such that the major axis is aligned in a slightly different direction. However, a combination of the different directions results in a direction illustrated by the lines.

Figure 1B:
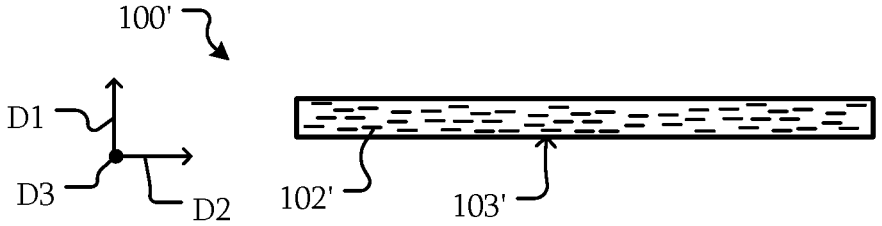
FIGS. 1B and 1C are block diagrams of target having a grain structure different from that of FIG. 1A.
Figure 1C:
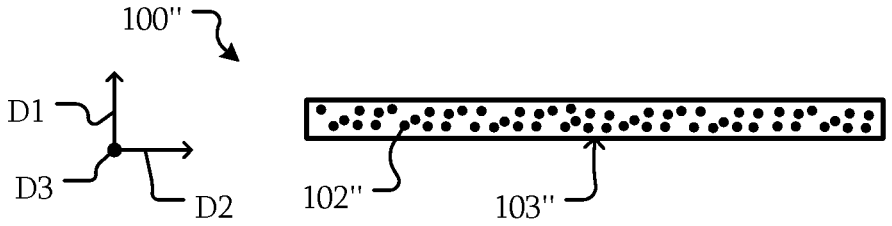

FIGS. 1B and 1C are block diagrams of target having a grain structure different from that of FIG. 1A. Referring to FIG. 1B, the target 100' has a target material having grains elongated along axis D2, perpendicular to axis D1. Such a target 100' may be formed by rolling or forging a target material into a sheet. Although the orientation of the grain structure 102' of the target 100' may be similar the target 100 of FIG. 1A, the grain structure 102' is aligned along a different axis D2. Referring to FIG. 1C, the target 100" includes a grain structure 102" where the grains are substantially equiaxed. Accordingly, a number of grains per unit area at a surface 103 of target 100 may be greater than that at a surface 103' of target 100' or a surface 103" of target 100".

As will be described in further detail below, in some embodiments, the target 100 may be formed by pressing, sintering, and forging the target material. However, in other embodiments, the target 100 may be formed using a different technique. The processing of the material forming the target 100 may result in the grain structure described herein. Pressing or hot pressing is a high-pressure, low-strain-rate powder metallurgy process for forming of a powder or powder compact at a temperature high enough to induce sintering and creep processes. Sintering is the process of compacting and forming a solid mass of material by heat and/or pressure without melting the material to the point of liquefaction, often used in powder metallurgy. Creep (sometimes called cold flow) is the tendency of a solid material to move slowly or deform permanently under the influence of persistent mechanical stresses. Forging is a manufacturing process involving the shaping of metal using localized compressive forces. The combinations of pressing, sintering, and forging can also be used to remove impurities from the target material.

Figure 2:
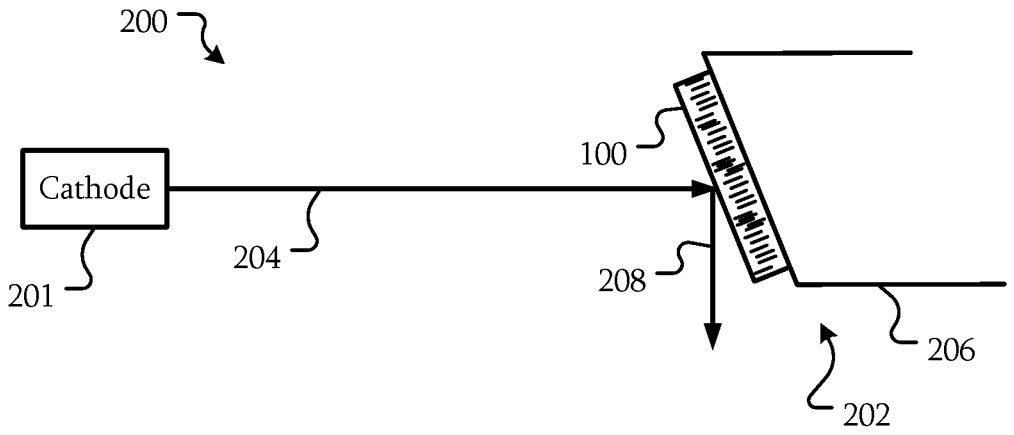
FIG. 2 is a block diagram of an x-ray system including a target having a grain structure according to some embodiments.
Figure 3:
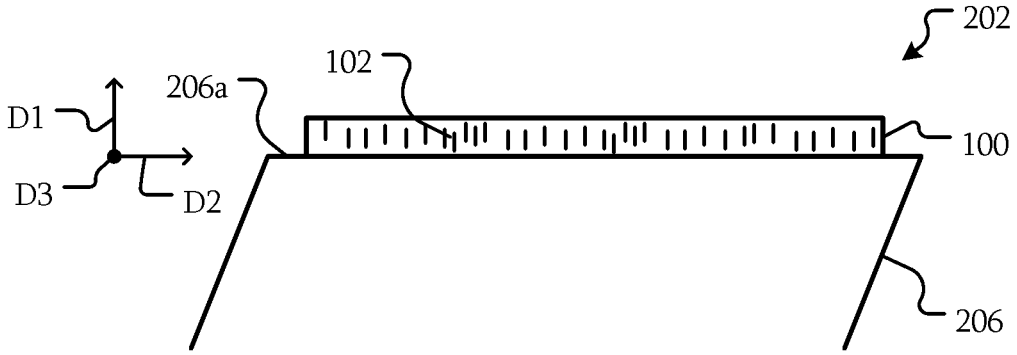
FIG. 3 is a block diagram of an anode of the x-ray system of FIG. 2 according to some embodiments.

FIG. 2 is a block diagram of an x-ray system including a target having a grain structure according to some embodiments. FIG. 3 is a block diagram of an anode of the x-ray system of FIG. 2 according to some embodiments. Referring to FIGS. 2 and 3, the x-ray system 200 includes a cathode 201 and an anode 202. The cathode 201 is configured to generate a particle beam 204, such as an electron beam. The cathode 201 may include an emitter such a bulk emitter, planar emitter, a filament, or the like. The cathode 201 may include other components such as grids, focusing/steering components, or the like.

The anode 202 includes a support structure 206 and target 100 similar to the target 100 of FIG. 1A. The support structure 206 may be formed of a variety of materials. For example, the support structure 206 may include copper, Glidcop, combinations of alloys of such materials, or the like. The support structure 206 may have properties designed for dissipating heat (a high thermal conductivity, cooling structures, or the like) generated by the target and/or maintaining structural integrity due to high temperatures generated from heat. In some embodiments, the support structure 206 may have a thermal conductivity greater than 100 or 200 watts per meter-Kelvin (W/(m·K)) at 20° Celsius (C). The target 100 is attached to a mounting surface **206*a* of the support structure 206. A target material may have a different rate or coefficient of thermal expansion rate from a support structure material. Thermal expansion is the tendency of matter to change its shape, area, and volume in response to a change in temperature. An interface between the target 100 and the mounting surface 206***a* may be susceptible to delamination and/or cracking due to thermal cycling and the different coefficients of thermal expansion rate between the target material and the support structure. In some embodiments, the mounting surface 206*a* is angled relative to the particle beam 204; however, in other the mounting surface 206*a* may have a different orientation. In some embodiments, the anode 202 may be a stationary anode; however, as will be described in further detail below, the anode 202 may be a rotating anode.

The grain structure 102 has a particular orientation relative to the mounting surface 206*a*. Axis D1 is perpendicular to the mounting surface 206*a*. Axis D2 is parallel to the mounting surface 206*a*. The grain structure 102 has a first dimension along the axis D1 perpendicular to the mounting surface 206*a* that is longer than a longest dimension along any axis parallel to the mounting surface 206*a* such as axis D2. Here, axis D2 is used as an example of an axis parallel to the mounting surface 206*a*, however, those axes may include different axes, such as axis D3 that extends out of the plane of the figure. In some embodiments, at least 80% or 95% to all of the target 100 has a grain structure 102 with a first dimension along the axis D1 perpendicular to the mounting surface 206*a* that is longer than a longest dimension along any axis parallel to the mounting surface 206*a* such as axis D2.

A result of the grain orientation relative to the mounting surface 206*a* is that for a given grain size, a number of grains per unit area at the interface between the target 100 and the mounting surface 206*a* may be relatively increased. This increase in the number of grains per unit area may reduce a probability that the target 100 delaminates from the support structure 206. A lower probability of delamination may lower a probability of cracking of the target 100 as the support structure 206 may be able to conduct heat from the target 100 more efficiently due to the maintained contact.

Figure 4A:
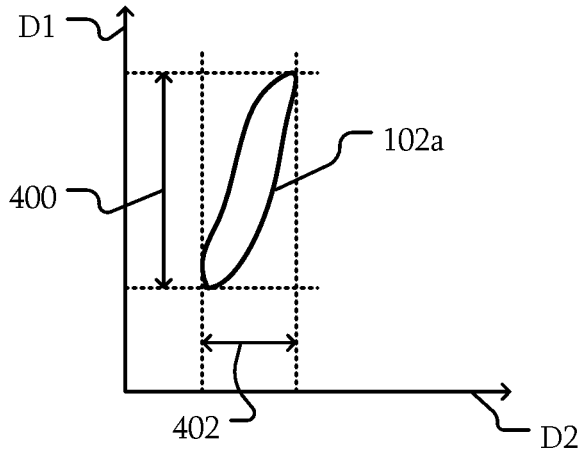
FIGS. 4A-4C are block diagrams illustrating orientations of a grain structure relative to the support structure of FIG. 3 according to some embodiments.
Figure 4B:
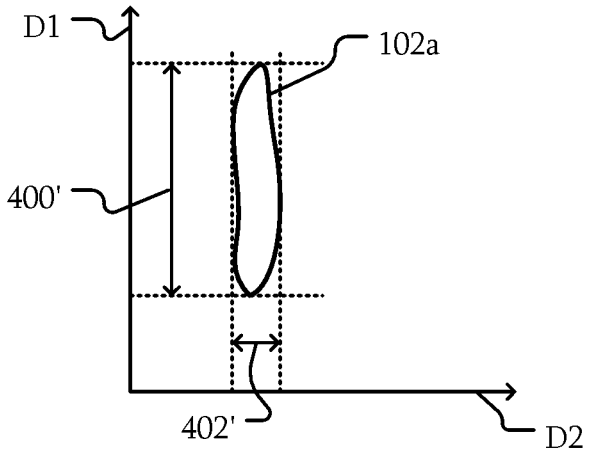
Figure 4C:
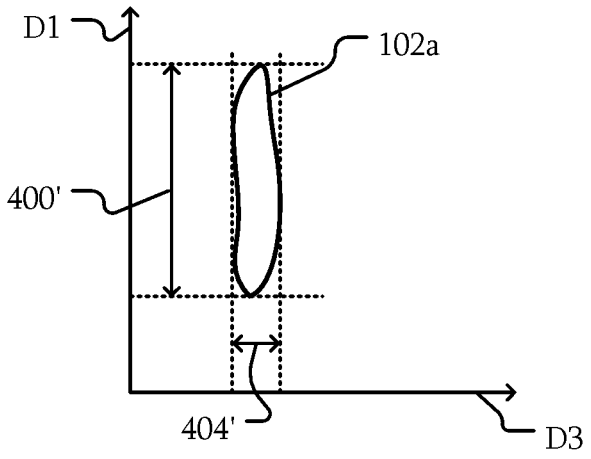

FIGS. 4A-4C are block diagrams illustrating orientations of a grain structure relative to the support structure of FIG. 3 according to some embodiments. Referring to FIG. 4A, axes D1 and D2 are the same as those of FIG. 3. A single grain 102*a* is used as an example of the general orientation of the grain structure 102. The grain 102*a* has a length 400 along axis D1 and a length 402 along axis D2. The length 400 is greater than the length D2.

As the length 400 along axis D1 may be greater than any length along an axis D2 or another axis perpendicular to axis D1, i.e., parallel to the mounting surface 206*a*, a number of grains per unit area at the interface between the target 100 and the mounting surface 206*a* may be larger in a plane perpendicular to axis D1 than in a plane perpendicular to axis D2 or other axis perpendicular to axis D1. In addition, as long as the length along axis D1 is greater, then the grain structure 102 of the target 100 may be oriented relative to the mounting surface 206*a* in a manner to improve the number of grains contacting the mounting surface 206*a*. In an example, the length 400 along axis D1 may be twice, four times, or ten times as great than any length along an axis D2 or another axis perpendicular to axis D1. In another example, the length 400 along axis D1 may be twice, four times, or ten times as great than any length along an axis D2 or another axis perpendicular to axis D1 for at least 80% or 95% to all of the target 100. In another example, the length 400 along axis D1 may be twice, four times, or ten times as great than any length along an axis D2 or another axis perpendicular to axis D1 for at least 80% or 95% to all of the interface between the target 100 and the mounting surface 206*a*.

Referring to FIG. 4B, another orientation of the grain 102*a* is illustrated as an example of the general orientation of the grain structure 102. Here, the major axis of the grain structure 102 is substantially parallel with the axis D1. That is, the grain structure 102 may aligned to axis D1. The length along axis D2 may be a minimum. Referring to FIG. 4C, the orientation of the grain 102*a* may be similar to the orientation of FIG. 4B relative to axes D1 and D3. Axis D3 may be perpendicular to both axes D1 and D2. The length 404' along axis D3 may also be a minimum. Accordingly, the grains of the grain structure are generally oriented to be elongated parallel to the axis D1. This orientation may maximize the grains per unit area at the interface between the target 100 and the mounting surface 206*a*. For example, the grains per unit area at the interface may substantially the greatest, greater than the grains per unit area on another surface of the target 100, and/or greater than the grains per unit area of any cross-section of the target.

Some applications of a target material in an x-ray system include a sheet material. The sheet material may be formed by pressing and sintering to form a blank. The blank may be rolled or forged into a sheet. As a result, the grain structure has a major axis that is generally in the plane of the sheet and aligned in the direction of the rolling used to form the sheet. As a result, when the sheet is used as a target, the grain structure may result in a long side of the grains contacting a support structure. A grain structure with the long side of the grains contacting a support structure will reduce the relative grains per unit area in contact with the support structure. This may increase the probability of the sheet material delaminating, which may lead to the failure of the x-ray system. Other techniques of forming a target include pressing and sintering to form a disc blank. The disc blank may be forged to a desired thickness. While the grain structure may be smaller and/or less elongated than when the blank is rolled into a sheet, the grain structure is expanded in the plane of the disk due to the forging, reducing the grains per unit area. In addition, a process of forming such a disc may be difficult to perform with an acceptable reliability and/or cost.

Using a target 100 as described herein results in a grain structure with a higher grain per unit area at a mounting interface between the target 100 and the mounting surface 206*a*. As a result, the interface of the target to the mounting surface 206*a* may be more resistant to stress induced by thermal cycling, such as that from a cyclical and/or pulsed operation of an x-ray system 200. As x-ray systems may be operated with thousands to millions of cycles over a lifetime, an improved resistance to thermal cycling may improve reliability of the overall system.

In some embodiments the orientation of the grain structure may be substantially the same throughout the target 100. However, in other embodiments, the grain structure may be oriented as described above, only at the interface between the target 100 and the mounting surface 206*a*. That is, the orientation of the grain structure may be different throughout the target 100 and/or may deviate from the orientation described above further from the mounting surface 206*a*.

Figure 5:
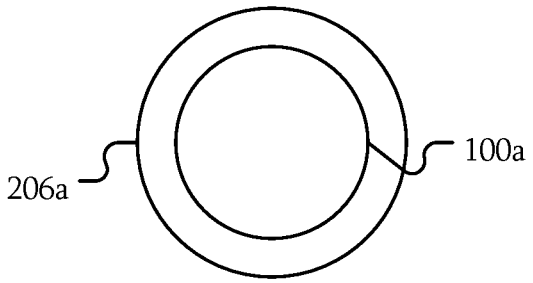
FIG. 5 is an overhead view of an anode of an x-ray system according to some embodiments.

FIG. 5 is an overhead view of an anode of an x-ray system according to some embodiments. In some embodiments, the mounting surface 206*a* may be similar to the mounting surface 206*a* of the support structure 206 described above. The mounting surface 206*a* may have a circular cross-section. However, in other embodiments, the cross-section of the mounting surface 206*a* may have a different shape. The target 100*a* may include a disc. The disc may have a minor axis perpendicular to the mounting surface 206*a*. That is, the disc 100*a* may have a relatively low aspect ratio where the diameter may be much larger than the thickness of the disc 100*a*. While a disc has been used as an example of the shape of the target 100*a*, in other embodiments, the target 100*a* may have a different shape. In addition, while the mounting surface 206*a* and the target 100*a* may have similar cross-sections, such as the illustrated circular cross-sections, the cross-sections of the mounting surface 206*a* and the target 100*a* may be different.

Figure 6:
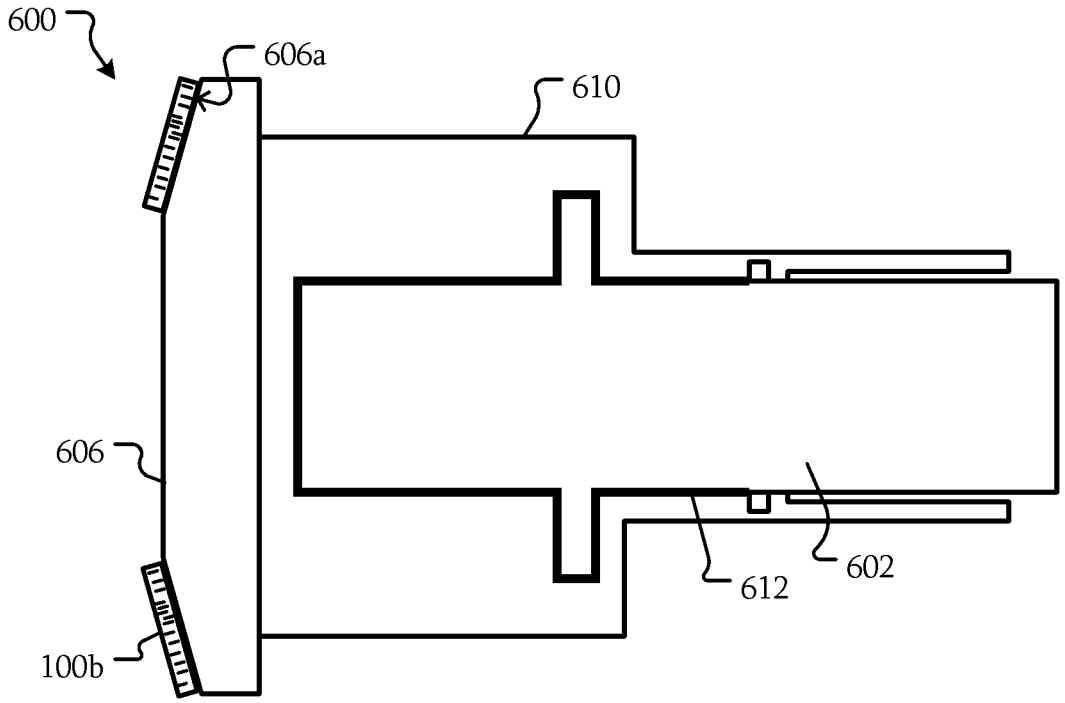
FIG. 6 is a block diagram of a rotating anode of an x-ray system according to some embodiments.

FIG. 6 is a block diagram of a rotating anode of an x-ray system according to some embodiments. In some embodiments, an x-ray system includes a rotating anode 600. The rotating anode 600 includes a support structure 602 and a bearing assembly 610. In some embodiments, the support structure 602 and the bearing assembly 610 are rotatably coupled by a hydrodynamic bearing 612. In other embodiments, the support structure 602 and the bearing assembly 610 may be rotatably coupled in other ways such as through ball bearings.

A target 100*b* is attached to a mounting surface 606*a*. The target 100*b* may include a grain structure aligned similar to the relationship between the grain structure of the target 100 and the mounting surface 206*a* described above. For example, the grain structure of the target 100*b* may be generally perpendicular to the mounting surface 606*a*. This relationship may be maintained even though the mounting surface 606*a* is a curved annular shape.

Figure 7:
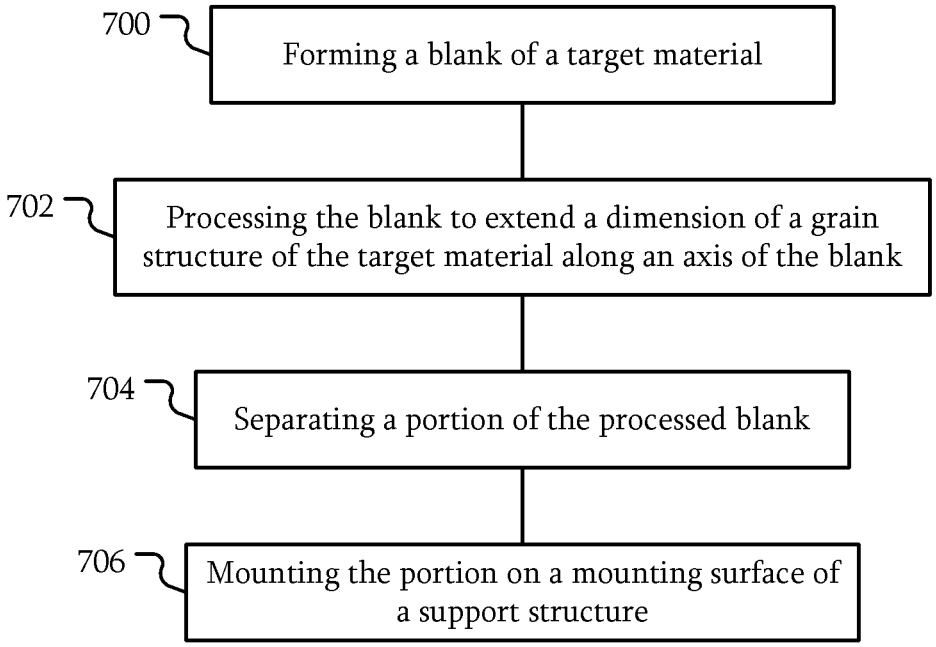
FIG. 7 is flowchart of a technique of forming an x-ray system according to some embodiments.
Figure 8A:
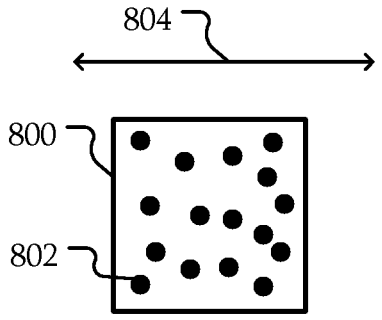
FIG. 8A-8C are block diagrams illustrating the formation of a target for an x-ray system according to some embodiments.
Figure 8B:
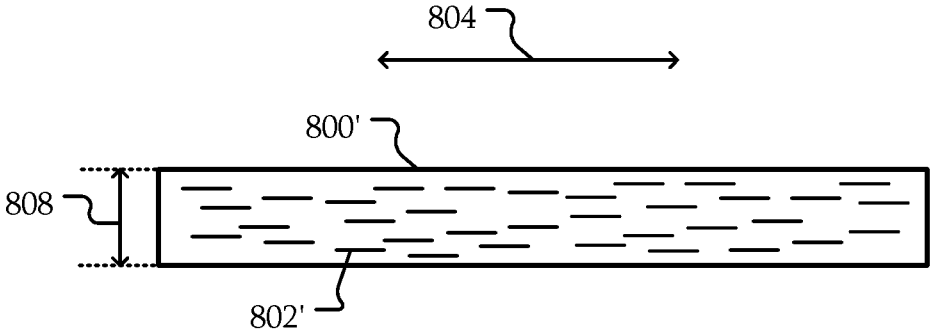
Figure 8C:
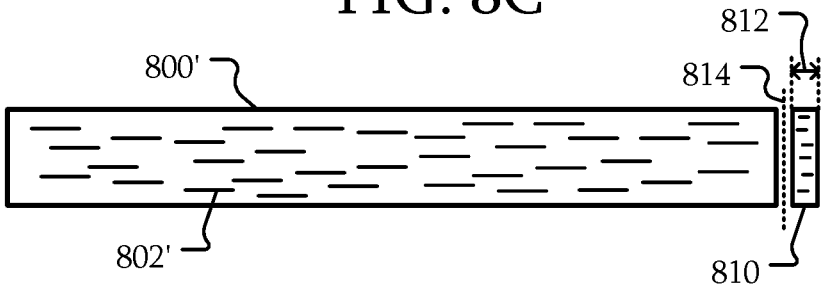

FIG. 7 is flowchart of a technique of forming an x-ray system according to some embodiments. FIGS. 8A-8C are block diagrams illustrating the formation of a target for an x-ray system according to some embodiments. The structures of FIGS. 8A-8C will be used as an example; however, in other embodiments, the operations may result in different structures.

Referring to FIGS. 7 and 8A, in 700 a blank 800 of a target material is formed. For example, a powder material such as tungsten, rhenium, rhodium, palladium, combinations of alloys of such materials, or the like may be pressed into the blank 800. The blank 800 may be sintered. In some embodiments, the material may be formed into a blank 800 in the shape of a rod. Regardless of the shape of the blank 800, the grains 802 of the blank may have lengths that are substantially the same along any axis. This shape of the grains 802 is represented by the circular shapes. The grain of a material can also be referred to as a crystallite, which is a small or microscopic crystal structure which can form during the cooling of many materials. The initial orientation of crystallites is typically random with no preferred direction, but can be directed through growth and processing conditions. The areas where crystallites meet are known as grain boundaries. The powder material used in the blank can include grains or crystallites of the material.

Referring to FIGS. 7 and 8B, in 702, the blank 800 is processed to extend a dimension of a grain structure 802 of the target material along an axis 804 of the blank. The elongated grain structure 802' is represented by lines to illustrate the elongation along the axis 804.

The elongation may be performed in a variety of ways. For example, the blank 800 may be forged, rolled, drawn, pulled, extruded, compressed, or the like to extend the length along axis 804. As described above, the blank 800 may have a rod shape. The resulting processed blank 800' may still have a general shape of an elongated rod, wire, or the like.

In some embodiments, a dimension 808 of the processed blank 800' may be at or near a final dimension of the target 100. For example, a diameter of a rod may be substantially the same as the diameter of the disc 100*a* described above. The processing in 702 may be performed until a diameter of the rod is less than or equal to a corresponding dimension of the mounting surface.

In 704, a portion 810 of the processed blank 800' may be separated. For example, the portion 810 may be separated by cutting, machining, or the like. The separation operation may be performed in a plane 814 that results in the grain structure as described above. For example, the plane 814 may be substantially perpendicular to the elongation of the grain structure 802'. That is, the portion 812 of the processed blank 800' may be separated such that the grain structure 802' of the portion 812 has a first dimension along an axis perpendicular to the mounting surface that is greater than a dimension along an axis parallel to the mounting surface similar to the target 100 described above. In some embodiments, the resulting portion 812 may be a slice of a pressed sintered forged rod.

Further processing, such as forging, may be performed on the portion 812. For example, the portion 812 may be forged to achieve a desired thickness. In other embodiments, the portion 812 may have a thickness 810 that is at or near a final thickness of the target 100.

In some embodiments, the portion of the processed blank that is separated may have a thickness less than about 0.125 inches (in.) or 3.18 millimeters (mm). In other embodiments, the thickness may be less than about 0.050 in or 1.27 mm. In other embodiments, the thickness may be less than about 0.016 in or 0.41 mm. When the thickness of the portion is as thin as those described above, the interface may be more susceptible to delamination due to thermal cycling. The susceptibility may increase with decreasing thickness with the thicknesses of less than about 0.050 in. and less than about 0.016 in. being more susceptible.

In 706, the portion 812 is mounted on a mounting surface of a support structure. For example, the portion 812 may be mounted on an anode. The portion 812 may be mounted in a variety of ways, such as by back casting, brazing, welding (e.g., e-beam welding), or the like. The resulting structure may be similar to that of FIGS. 2, 3, 5, 6, or the like.

Figure 9:
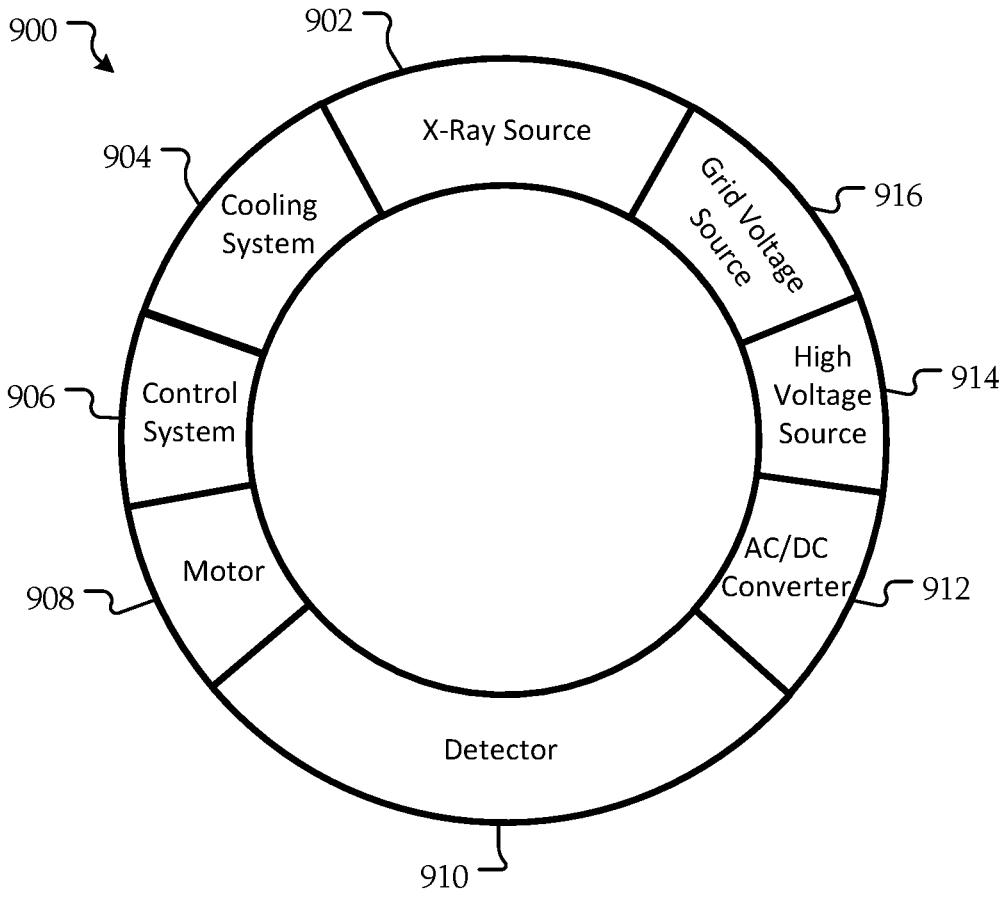
FIG. 9 is a block diagram of a computerized tomography (CT) gantry according to some embodiments.

FIG. 9 is a block diagram of a computerized tomography (CT) gantry according to some embodiments. In some embodiments, the CT gantry includes an x-ray source 902, a cooling system 904, a control system 906, a motor drive 908, a detector 910, an AC/DC converter 912, a high voltage source 914, and a grid voltage source 916. The x-ray source 902 may include an x-ray tube including a target 100 or the like as described above. Although particular components have been used as examples of components that may be mounted on a CT gantry, in other embodiments, the other components may be different. Although a CT gantry is used as an example of a system that includes an x-ray tube including a target 100 or the like as described above, an x-ray tube including a target 100 or the like as described above in may be used in other types of systems.

Figure 10:
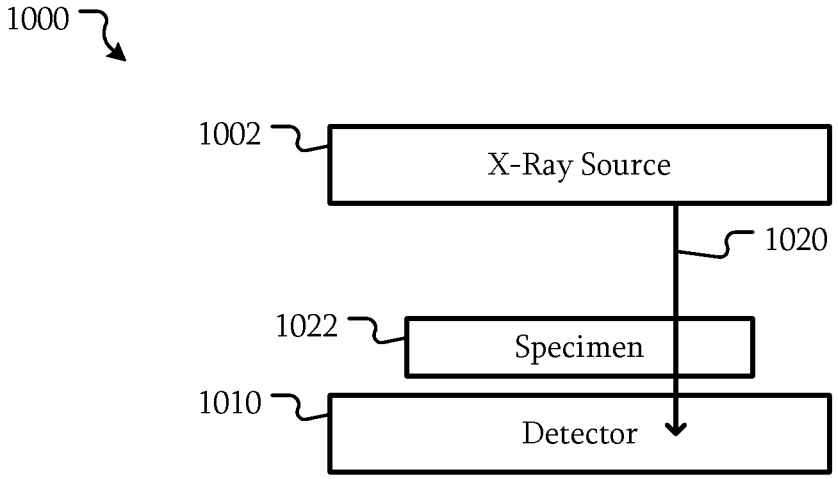
FIG. 10 is a block diagram of a 2D x-ray imaging system according to some embodiments.

FIG. 10 is a block diagram of a 2D x-ray imaging system according to some embodiments. The imaging system 1000 includes an x-ray source 1002 and a detector 1010. The x-ray source 1002 may include an x-ray tube including a target 100 or the like as described above. The x-ray source 1002 is disposed relative to the detector 1010 such that x-rays 1020 may be generated to pass through a specimen 1022 and detected by the detector 1010.

Some embodiments include an x-ray system 200, comprising: a support structure 106, 206, 606 including a mounting surface 106*a*, 206*a*, 606*a*; a target 100, 100*a*, 100*b* attached to the support structure 106, 206, 606 on the mounting surface 106*a*, 206*a*, 606*a*; wherein the target 100, 100*a*, 100*b* has a grain structure 102, 802' having a first dimension along an axis perpendicular to the mounting surface 106*a*, 206*a*, 606*a* is longer than a longest dimension along any axis parallel to the mounting surface 106*a*, 206*a*, 606*a*. As described above with respect to FIG. 4A, the major axis of a grain 102*a* may be rotationally offset relative to the axis D1 perpendicular to the mounting surface 106*a*, 206*a*, 606*a*. The rotational offset may be less than 45 degrees as a result of the dimension along the axis D1 being longer than the dimension along another, perpendicular axis such as axes D2 and D3. Thus, in some embodiments, the major axis of the grains may not be substantially parallel to the axis D1.

In some embodiments, a major axis of the grain structure 102, 802' is substantially parallel with the axis perpendicular to the mounting surface 106*a*, 206*a*, 606*a*.

In some embodiments, the target 100, 100*a*, 100*b* is a disc having a minor axis perpendicular to the mounting surface 106*a*, 206*a*, 606*a*.

In some embodiments, the target 100, 100*a*, 100*b* comprises a pressed sintered material.

In some embodiments, the target 100, 100*a*, 100*b* comprises at least one of tungsten, rhenium, rhodium, and palladium or an alloy of at least two of tungsten, rhenium, rhodium, and palladium.

In some embodiments, the target 100, 100*a*, 100*b* comprises a slice of a pressed sintered forged rod.

In some embodiments, a thickness of the target 100, 100*a*, 100*b* is less than about 0.050 inches.

In some embodiments, a location where the grain structure 102, 802' has the first dimension along the axis perpendicular to the mounting surface 106*a*, 206*a*, 606*a* that is longer than the longest dimension along any axis parallel to the mounting surface 106*a*, 206*a*, 606*a* is at an interface between the target 100, 100*a*, 100*b* and the mounting surface 106*a*, 206*a*, 606*a*.

In some embodiments, the x-ray system 200 further comprises a cathode; and an anode 202, 600; wherein the support structure 106, 206, 606 is part of the anode 202, 600.

In some embodiments, the anode 202 is a stationary anode 202.

In some embodiments, the anode 202 is a rotating anode 600.

In some embodiments, a surface of the target 100, 100*a*, 100*b* contacting the mounting surface 106*a*, 206*a*, 606*a* comprises a greatest number of grains per unit area of surfaces of the target 100, 100*a*, 100*b*.

Some embodiments include an x-ray system 200 formed by a process comprising: forming a blank 800 of a target 100, 100*a*, 100*b* material; processing the blank 800 to extend a dimension of a grain structure 102, 802' of the target 100, 100*a*, 100*b* material along an axis of the blank; separating a portion 810 of the processed blank 800'; and mounting the portion on a mounting surface 106*a*, 206*a*, 606*a* of a support structure 106, 206, 606 of an anode 202; wherein the portion 812 of the processed blank 800' is separated such that the grain structure 102, 802' of the portion 812 has a first dimension along an axis perpendicular to the mounting surface 106*a*, 206*a*, 606*a* that is greater than a dimension along an axis parallel to the mounting surface 106*a*, 206*a*, 606*a*.

In some embodiments, forming the blank 800 of the target 100, 100*a*, 100*b* material comprises forming a rod; and processing the blank 800 comprises extending a length of the rod.

In some embodiments, forming the rod comprises: pressing the target 100, 100*a*, 100*b* material into the blank 800; and sintering the blank 800.

In some embodiments, extending the length of the rod comprises extending the length of the rod until a diameter of the rod is less than or equal to a corresponding dimension of the mounting surface 106*a*, 206*a*, 606*a*.

In some embodiments, separating the portion 812 of the processed blank 800' comprises cutting the portion 812 from the processed blank 800' along a plane perpendicular to the extended dimension of the grain structure 102, 802' of the target 100, 100*a*, 100*b* material.

In some embodiments, mounting the portion 812 on the mounting surface 106*a*, 206*a*, 606*a* of the support structure 106, 206, 606 of the anode 202 comprises one of: back casting the support structure 106, 206, 606 to the portion 812; brazing the portion 812 to the support structure 106, 206, 606; and welding the portion 812 to the support structure 106, 206, 606.

Some embodiments include an x-ray system, comprising: means for generating a particle beam; means for supporting; and means for converting at least part of the particle beam including means for attaching the means for converting the at least part of the particle beam to the means for supporting with a number of grains per unit area greater than a number of grains per unit area in a plane perpendicular to the means for supporting.

Examples of the means for generating the particle beam include the cathode 201 or the like. Examples of the means for supporting include the support structures 206, 606, or the like. Examples of the means for converting at least part of the particle beam include the target 100, 600, or the like. Examples of the means for attaching the means for converting the at least part of the particle beam to the means for supporting with a number of grains per unit area greater than a number of grains per unit area in a plane perpendicular to the means for supporting include the portions of the targets 100, 600, or the like having the grain structure described above.

In some embodiments, the means for attaching the means for converting the at least part of the particle beam to the means for supporting comprises means for attaching the means for converting the at least part of the particle beam to the means for supporting with a substantially greatest number of grains per unit area, where substantially greatest number of grains per unit area is within 5% of a possible greatest number of grains per unit area. Examples of the means for attaching the means for converting the at least part of the particle beam to the means for supporting with a greatest number of grains per unit area include a target 100, 600, or the like having a grain structure as described with respect to FIGS. 4B and 4C.

Although the structures, devices, methods, and systems have been described in accordance with particular embodiments, one of ordinary skill in the art will readily recognize that many variations to the particular embodiments are possible, and any variations should therefore be considered to be within the spirit and scope disclosed herein. Accordingly, many modifications may be made by one of ordinary skill in the art without departing from the spirit and scope of the appended claims.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the claims beginning with claim [x] and ending with the claim that immediately precedes this one," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claims 1, 2, or 3, with these separate dependencies yielding three distinct embodiments; claim 5 can depend from any one of claims 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed to cover the corresponding structure, material, or acts described herein and equivalents thereof in accordance with 35 U.S.C. § 112 ¶6. Embodiments of the invention in which an exclusive property or privilege is claimed are defined as follows.

The invention claimed is:

1. An x-ray system, comprising:

a support structure including a mounting surface;

a target attached to the support structure on the mounting surface;

wherein the target has a grain structure having a first dimension along an axis perpendicular to the mounting surface is longer than a longest dimension along any axis parallel to the mounting surface.

2. The x-ray system of claim 1, wherein a major axis of the grain structure is substantially parallel with the axis perpendicular to the mounting surface.

3. The x-ray system of claim 1, wherein the target is a disc having a minor axis perpendicular to the mounting surface.

4. The x-ray system of claim 1, wherein the target comprises a pressed sintered material.

5. The x-ray system of claim 1, wherein the target comprises at least one of tungsten, rhenium, rhodium, and palladium or an alloy of at least two of tungsten, rhenium, rhodium, and palladium.

6. The x-ray system of claim 1, wherein the target comprises a slice of a pressed sintered forged rod.

7. The x-ray system of claim 1, wherein a thickness of the target is less than about 0.050 inches.

8. The x-ray system of claim 1, wherein a location where the grain structure has the first dimension along the axis perpendicular to the mounting surface that is longer than the longest dimension along any axis parallel to the mounting surface is at an interface between the target and the mounting surface.

9. The x-ray system of claim 1, further comprising:

a cathode; and an anode;

wherein the support structure is part of the anode.

10. The x-ray system of claim 9, wherein the anode is a stationary anode.

11. The x-ray system of claim 9, wherein the anode is a rotating anode.

12. The x-ray system of claim 1, wherein a surface of the target contacting the mounting surface comprises a greatest number of grains per unit area of surfaces of the target.

13. An x-ray system formed by a process comprising:

forming a blank of a target material;

processing the blank to extend a dimension of a grain structure of the target material along an axis of the blank;

separating a portion of the processed blank; and mounting the portion on a mounting surface of a support structure of an anode;

wherein the portion of the processed blank is separated such that the grain structure of the portion has a first dimension along an axis perpendicular to the mounting surface that is greater than a dimension along an axis parallel to the mounting surface.

14. The x-ray system of claim 13, wherein:

forming the blank of the target material comprises forming a rod; and processing the blank comprises extending a length of the rod.

15. The x-ray system of claim 14, wherein forming the rod comprises:

pressing the target material into the blank; and sintering the blank.

16. The x-ray system of claim 14, wherein extending the length of the rod comprises extending the length of the rod until a diameter of the rod is less than or equal to a corresponding dimension of the mounting surface.

17. The x-ray system of claim 13, wherein separating the portion of the processed blank comprises cutting the portion from the processed blank along a plane perpendicular to the extended dimension of the grain structure of the target material.

18. The x-ray system of claim 13, wherein mounting the portion on the mounting surface of the support structure of the anode comprises one of:

back casting the support structure to the portion;

brazing the portion to the support structure; and welding the portion to the support structure.

19. An x-ray system, comprising:

means for generating a particle beam;

means for supporting; and means for converting at least part of the particle beam including means for attaching the means for converting the at least part of the particle beam to the means for supporting with a number of grains per unit area greater than a number of grains per unit area in a plane perpendicular to the means for supporting.

20. The x-ray system of claim 19, wherein the means for attaching the means for converting the at least part of the particle beam to the means for supporting comprises means for attaching the means for converting the at least part of the particle beam to the means for supporting with a substantially greatest number of grains per unit area.

* * * * *